US005545286A

United States Patent [19]

Schaupp

[11] Patent Number: 5,545,286

[45] Date of Patent: Aug. 13, 1996

[54] ROTARY MAGAZINE SYSTEM FOR LABELER

[75] Inventor: Richard E. Schaupp, Modesto, Calif.

[73] Assignee: Smyth Systems Company, St. Paul, Minn.

[21] Appl. No.: 377,297

[22] Filed: Nov. 10, 1994

[51] Int. Cl.[6] ..... B65C 9/00

[52] U.S. Cl. ..... 156/570; 156/568; 156/571; 156/DIG. 29; 221/105; 271/3.01; 271/157

[58] Field of Search ..... 271/3.01, 9.08, 271/9.12, 157, 158; 221/104, 105, 106; 156/568, 570, 571, 565, 567, 573, DIG. 29

[56] References Cited

U.S. PATENT DOCUMENTS

| | | | |
|---|---|---|---|
| 3,929,326 | 12/1975 | Seragnoli | 271/3.01 |
| 4,333,586 | 6/1982 | Stuckler | 221/106 |
| 4,662,624 | 5/1987 | Focke | 271/157 |
| 5,203,953 | 4/1993 | Focke et al. | 156/570 X |

*Primary Examiner*—James Engel
*Attorney, Agent, or Firm*—Jennifer K. Farrar

[57] ABSTRACT

A system for dependably supplying stacks of labels to a high speed labeling machine. The system includes four primary parts. A plurality of cartridges for carrying stacks of labels, each of the cartridges has a release mechanism at the lower end of the cartridge. A carousel for carrying the cartridges in a vertical orientation with release mechanism of the cartridges directed downward. An arcuate chute having a centerpoint of the arcuate pathway defined by the chute. The upper port of the chute is situated in the system to receive the release mechanism of the cartridges carried on the carousel. A retractable paddle carried on a first end of a lever arm, the lever arm having a pivot mount in common with the centerpoint of the arcuate chute, and a counterweight at a second end of the lever arm. The carousel includes a vertical movement to sequentially lower each of the cartridges into contact with the upper port of the chute and release any stack of labels therein onto the retractable paddle. A method is also disclosed.

20 Claims, 7 Drawing Sheets

ROTARY MAGAZINE SYSTEM FOR LABELER

BACKGROUND OF THE INVENTION

The present invention relates to high speed labeling and more particularly to a magazine supply system for a high speed labeler. Most specifically, the present invention relates to a high speed label delivery system for providing stacks of labels to a high speed labeler.

Labels are supplied to high speed labeling equipment in two basic manners. In a first type of labeling machine, labels are provided to the labeling machine on a web. In a second type of machine, labels are provided in a stack. Although it would seem that a large number of labels could be supplied with ease in a stack, the speed with which such labels are applied in the modern packaging and labeling industry results in a stack of labels being used at rate on the order of a inch per second. The need to avoid jamming and shutting down a labeling machine is significant in economic terms. The labeling industry therefore places a premium is on dependability of supply systems to high speed labelers and on the related savings in labor and scheduling in packaging lines.

It might also be suspected that merely dropping a tall stack of labels on top of a nearly consumed preceding stack of labels would be a simple solution. Unfortunately, a free falling stack of labels occasionally experiences the bottom most label or labels temporarily separating from the stack. In turn, a proportion of such temporarily separated labels lose their original alignment relative to the stack, and of those misaligned labels a few subsequently are misoriented when applied to product packages or alternatively jam the labeling machine.

It is an object of the present invention to provide a device capable of dependably and rapidly supplying a stack of labels to a high speed labeling machine. It is also an object of the present invention to provide a mechanism for dropping sequential stacks of labels without separation of the bottom most labels of the stacks from the main bodys of the stacks. It is a further object of the present invention to provide a series of supply tubes or cartridges such that stacks of labels may be prepared and awaiting feeding into a high speed labeler. These objects and others are believed to be provided by the present invention.

SUMMARY OF THE INVENTION

The present invention in a first embodiment is a system for dependably supplying stacks of labels to a high speed labeling machine. The inventive system includes four primary components. First, a plurality of cartridges for carrying stacks of labels, each of the cartridges has a release mechanism at the lower end of the cartridge. Second, a carousel for carrying the cartridges in a vertical orientation with release mechanism of the cartridges directed downward. Third, an arcuate chute having a centerpoint of the arcuate pathway defined by the chute. The upper port of the chute is situated in the system to receive the release mechanism of the cartridges carried on the carousel. Fourth, a retractable paddle carried on a first end of a lever arm, the lever arm having a pivot mount in common with the centerpoint of the arcuate chute, and a counterweight at a second end of the lever arm. In a preferred embodiment, the carousel includes a vertical movement to sequentially lower each of the cartridges into contact with the upper port of the chute and release any stack of labels therein onto the retractable paddle.

In another embodiment, the present invention includes a device for supplying stacked labels to a labeling machine. The device includes a cartridge for carrying a stack of labels, a chute, located below the cartridge, for receiving the stack of labels from the cartridge, and guide means for controlling a lower most label of the stack of labels while the stack moves downward or is lowered from the cartridge into the chute. Preferably, the chute defines an arcuate pathway and the guide means includes a lever arm and pivot. Preferably, the pivot is generally common with or the same as the centerpoint of the arcuate pathway. Preferably, the guide means further includes a counter balance weight and further may preferably include a tipping paddle or other retractable engagement means for contacting the lower most label. If, as in the most preferred embodiment, the retractable engagement means moves toward the counterweight to disengage from the lower most label subsequent to controlling the lowermost label, then the device quickly prepares to control another subsequently released stack of labels.

The present invention is also a method for resisting separation of a lowermost label from a dropping stack of labels. In the method the following steps occur. A paddle is provided which has a generally upward directed surface for initial contact with the underside of the lowermost object of the stack, such as a stack of labels. An upward directed force is provided to the paddle. This force is sufficient to resist the separation of the lowermost label but insufficient to substantially impede the drop of the stack. Preferably, the method also includes the step of withdrawing the paddle from under the lowermost label subsequent to lowering the stack of labels. Preferably, the paddle is carried on a lever arm having a pivot and a counter weight and the withdrawal step includes moving the paddle toward the counter weight. Withdrawal of the paddle toward the counter weight allows the paddle to return to an initial position to control the lower most label of a subsequent stack of labels.

DESCRIPTION OF THE PREFERRED EMBODIMENTS

Figure 1:
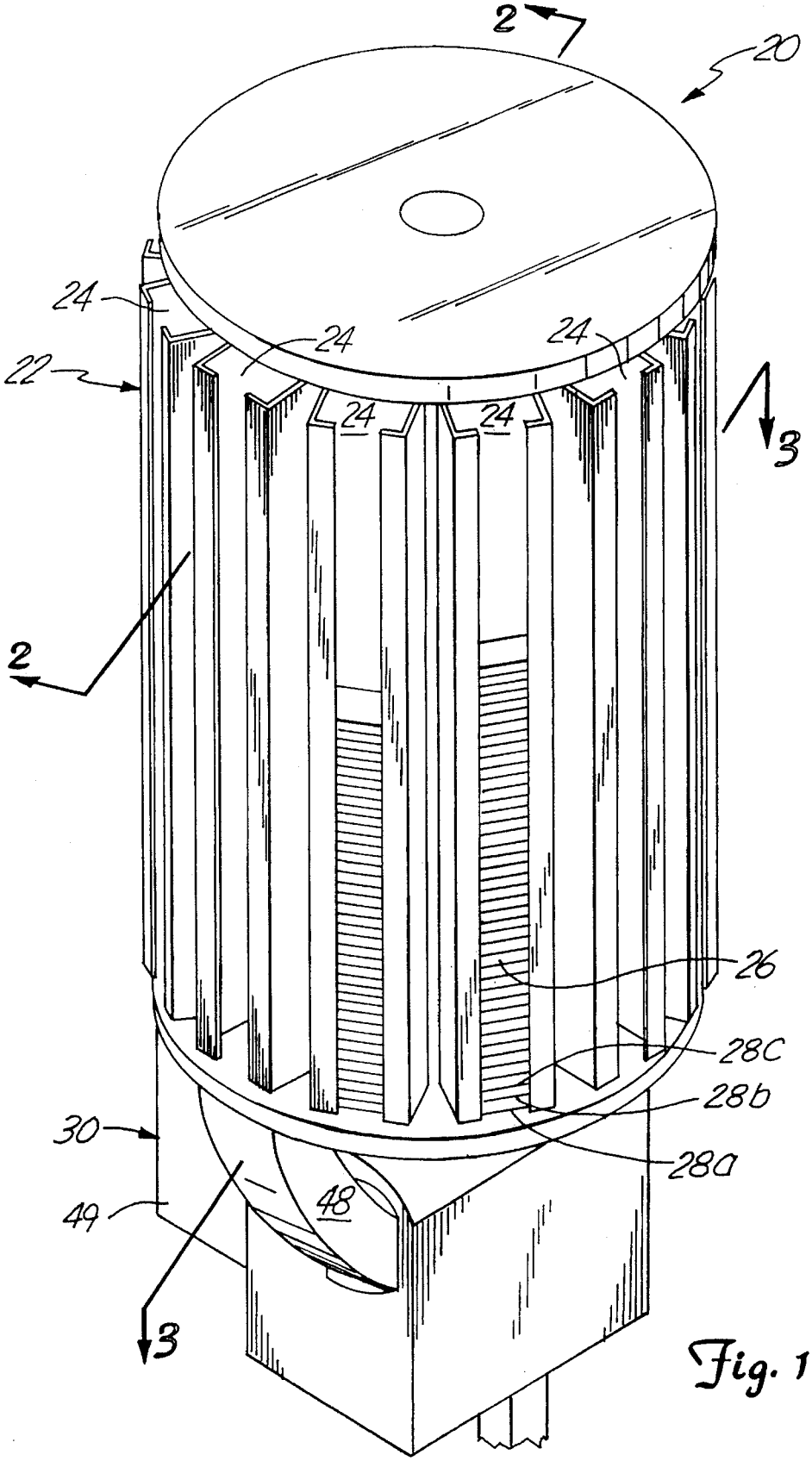
FIG. 1 is a schematic perspective view of a rotary magazine system of the present invention.

The present invention supplies stacks of labels to high speed labeling machines, such as by way of example, a rotary placer machine. In a preferred embodiment, the system 20 of the present invention, as shown in FIG. 1, may be considered in two major portions. The upper portion 22 has a plurality of interchangeable cartridges 24 for carrying and delivering stacks 26 of labels 28*a, b, c, . . . ,* n-1, and *n* to a lower portion 30 which interfaces with the cartridges 24 and feeds the stacks 26 of labels 28 to a labeling machine 49, below. By "labels" herein is meant traditional labels for application to substrates as well as other sheet-like or planar-like stackable objects, such as coupons, folded coupons, stickers, inserts etc. which are handled as stacks in the labeling industry.

Figure 2:
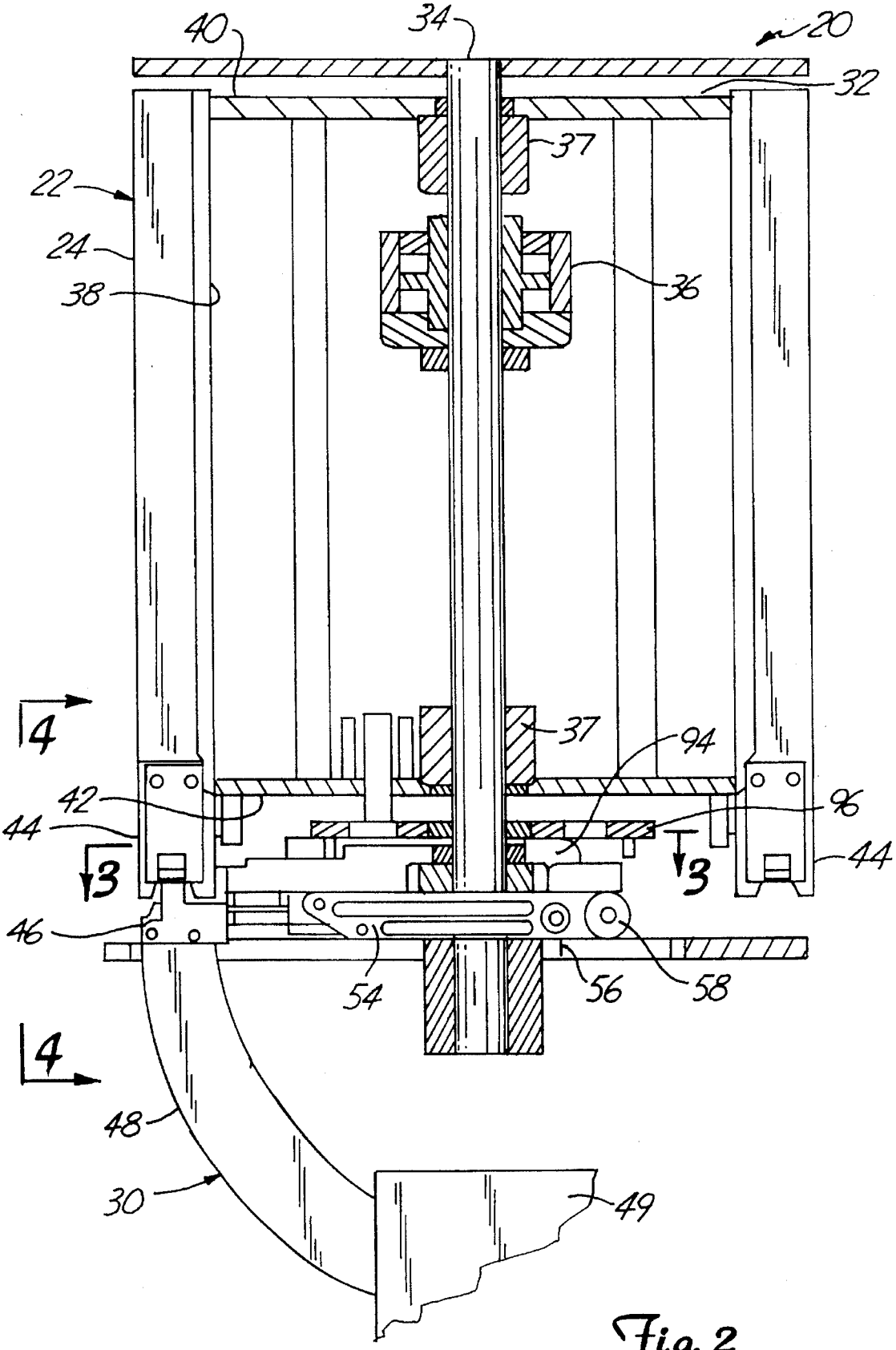
FIG. 2 is a schematic sectional view of the system of the present invention along line 2—2 of FIG. 1.

The upper portion 22, as shown in FIG. 2, includes a carousel 32 carried on a shaft 34. The carousel 32 revolves about the shaft 34. Additionally, the carousel 32 moves vertically up and down on the shaft 34, as directed by an air cylinder 36. Linear bushings 37 hold the shaft 34 on its axis while allowing vertical motion. The cartridges 24 are carried by the carousel 32 near its periphery 38. The carousel 32 also includes an upper plate 40 and a lower plate 42.

The motion of the carousel 32 is to first vertically elevate, then rotate approximately 30° about shaft 34, then drop down to its original elevation. When the carousel 32 drops, a gross indexing mechanism assures that a lower end 44 of a cartridge 24 will engage the upper port 46 of a chute 48. A fine adjustment mechanism is also present, as will be discussed below, to further assure precise alignment of cartridges to chute. Such engagement releases a stack 26 of labels 28 *a–n* to drop downward into chute 48 to be fed as a stack 26 onto the top of preceding stacks of labels. As will be explained subsequently, the release and drop of stacks 26 into chute 48 is carefully and eloquently controlled to prevent jamming or other disruption to the operation of a high speed labeler (not shown) below.

Alternatively, when elevated, the carousel 32 may be freely rotated by an operator installing filled cartridges 24 (i.e. loaded with a stack 26 of labels 28 *a, b, c,* n-1, *n*) or removing empty cartridges 24. A safety pawl within the vertical lift air cylinder 36, locks the carousel temporarily in the raised condition. The detail of the reversible attachment of the detachable cartridges 24 to the carousel 32 will be explained subsequently.

As mentioned earlier, the release and drop of stacks 26 into chute 48 is carefully and eloquently controlled to prevent jamming or other disruption to the operation of the high speed labeler (not shown) below. It has been observed by the inventor that a free falling stack of labels occasionally experiences the bottom most label or labels temporarily separating from the stack. In turn, a proportion of such temporarily separated labels shift from the original alignment with the stack, and of those a few subsequently are misoriented when applied to product packages or alternatively jam the labeling machine. The tendency of the bottom most label 28 *a* to separate from the stack 26 is thought to involve the rapid release of pressure from underneath the bottom most label 28 *a* when the stack 26 is released, resulting in the bottom most label 28 *a* springing downward and away from the stack 26.

Figure 3:
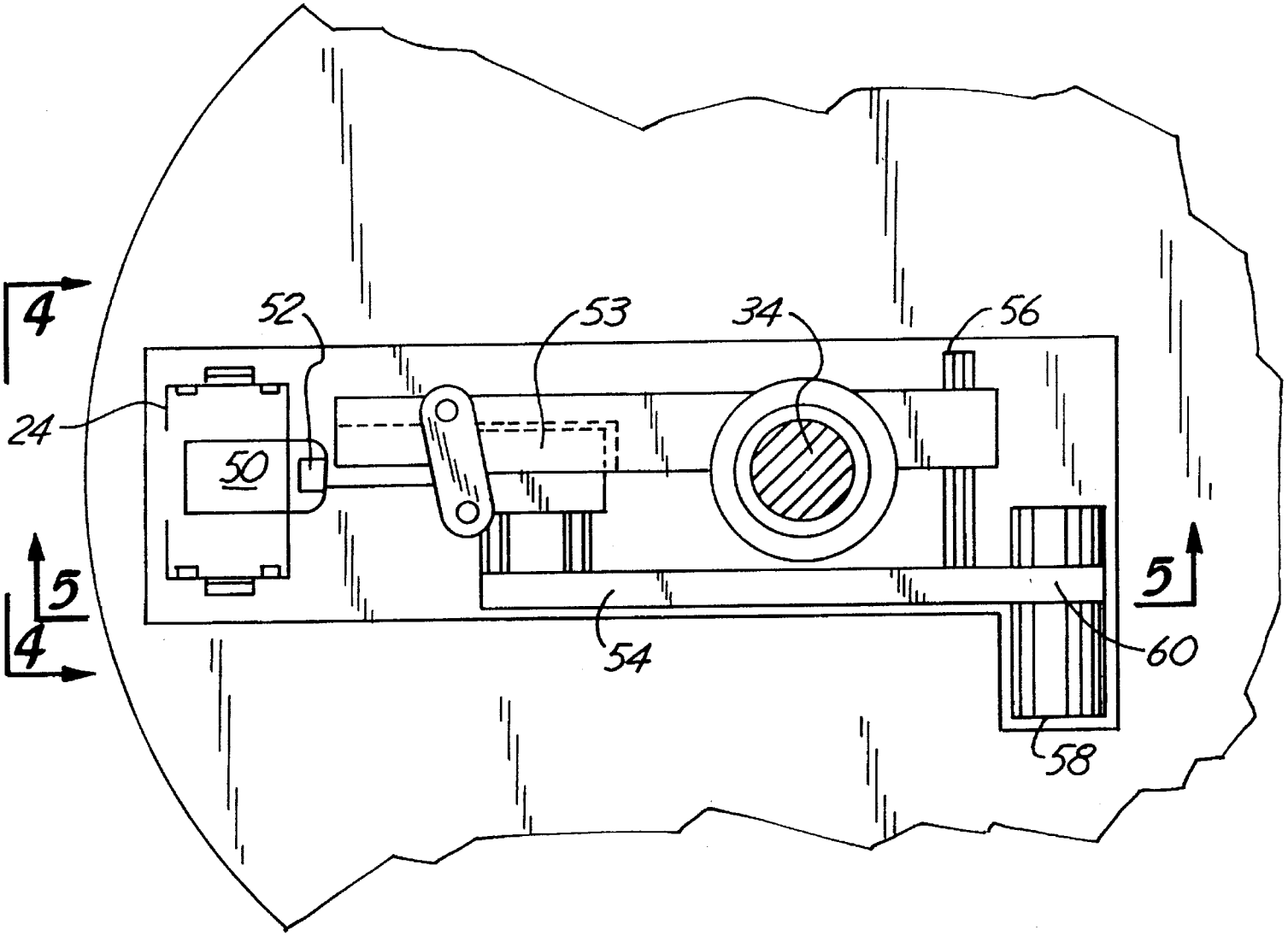
FIG. 3 is a partial schematic sectional view of the system of the present invention along line 3—3 of FIG. 1.

One aspect of the present invention involves controlling or preventing the bottom most label 28 *a* from separating from the stack 26 by providing by the provision of a force resisting such separation. Specifically, a tipping paddle 50, as shown in FIG. 3, urges the bottom most label 28 *a* upward against the next label 28 *b* of the stack 26 during the downward drop of the stack 26 from its initial elevation in the cartridge 24 into the chute 48. The tipping paddle 50 is carried at a first end 52 of a lever arm 54. The lever arm 54 is mounted on a pivot 56, preferably including needle bearings, and has a counter weight 58 affixed adjacent its second end 60. The path followed by the tipping paddle 50 when the stack 26 is dropping is arcuate and lies within the chute 48. The chute 48 is also arcuate in shape and preferably shares a common center with the pivot 56 of the lever arm 54 carrying tipping paddle 50. Because the length of the lever arm 54 from the pivot 56 to the tipping paddle 50 is also generally the same as the radius of the arcuate chute 48, the tipping paddle 50 travels in a downward arcuate path within the chute 48. Preferably the radius is about 10 inches. The chute 48 also includes a large broad slot 51 on its inward edge to accommodate the arcuate passage of the tipping paddle 50. The slot 51 lies on the inside curved surface of the chute 48.

The lever arm 54 carrying the tipping paddle 50 also includes a double action air cylinder 53 to shorten or extend the lever arm 54, so as to retract or withdraw the tipping pad from the chute 48 through the slot 51 or to extend or insert the tipping paddle 50 into the slot 51. Note that in a preferred embodiment, the extended tipping paddle 50 has only a minor tendency to be counterbalanced by the counter weight 58, but a greater counterbalancing is present when the tipping paddle is retracted. This provides for a relatively rapid return to an initial generally horizontal orientation of the lever arm 54, tipping paddle 50 and counterweight 58. In this return, the pathway followed by the retracted tipping paddle 50 lies closer to pivot 56 and avoids the interior of arcuate chute 48. This in turn allows the tipping paddle 50 to avoid contact with the stack 26 of labels 28 *a . . . n* as well as to quickly return since the distance from the tipping paddle 50 to the pivot 50 is reduced, while the distance from the pivot to the counterweight remains constant.

Subsequently, after returning to a near horizontal orientation, the tipping paddle 50 is again extended into the interior of the arcuate chute 48, near upper port 48. Within the lever arm 54, guide and watching slides are included to prevent the tipping paddle 50 from twisting and thereby losing its orientational relationship with the pivot 56. Specifically, the plane of the upper surface of the tipping paddle 50 remains generally tangential to the axis of the pivot 56, when the tipping paddle 50 is extended or retracted and when the lever arm 54 is horizontal or inclined to lower the tipping paddle 50, or moving between those extremes.

As a stack 26 of labels 28 is released, the extended tipping paddle 50 contacts the bottom most label 28 *a* and prevents it from separating from the stack 26. Once the stack 26 and tipping paddle 50 come to rest atop other previously dropped stacks of labels, the interposed tipping paddle 50 is retracted or withdrawn, resulting in the stack 26 being dropped into place with careful control that the bottom most label 28 *a* is not separated from the stack 26. It will also be recognized that the inertia of the tipping paddle 50, arm 54 and counterweight 58 are also significant in resisting initial separation, i.e. immediately subsequent to release of the stack.

Figure 5:
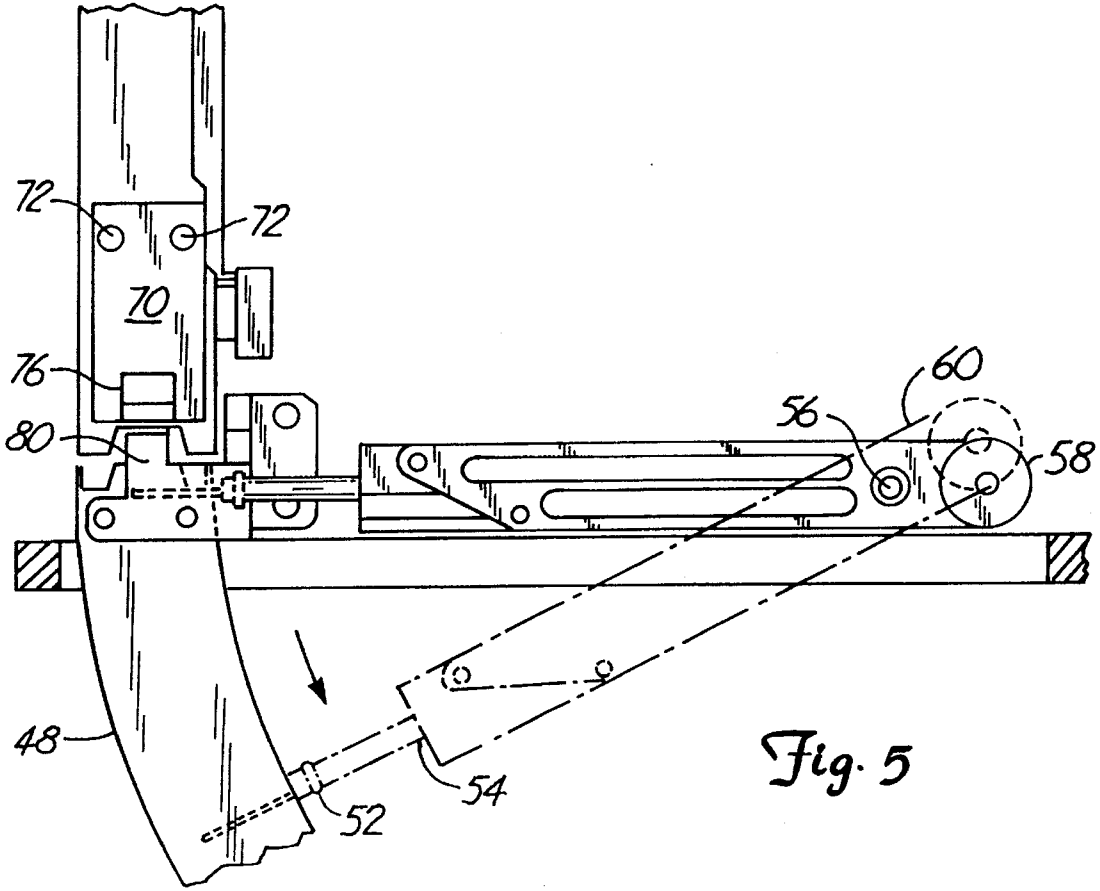
FIG. 5 is a partial schematic sectional view of the system of the present invention along line 5—5 of FIG. 4 with a tipping paddle, partially descended, shown in outline.
Figure 4:
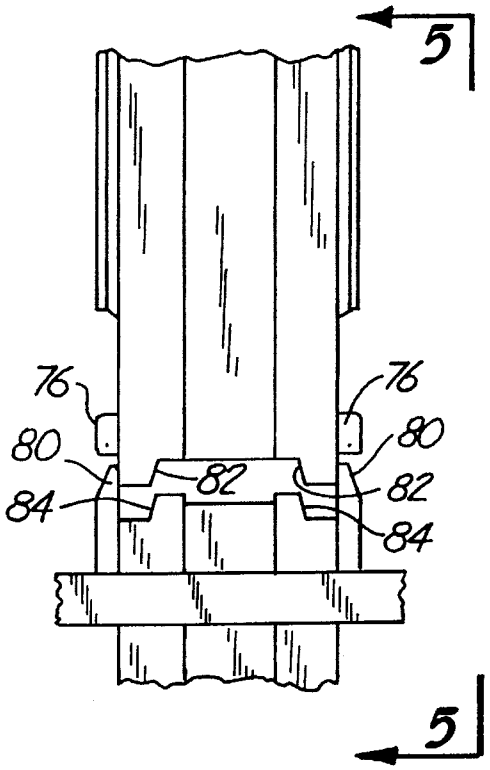
FIG. 4 is a partial schematic sectional view of the system of the present invention along line 4—4 of FIG. 3.
Figure 6:
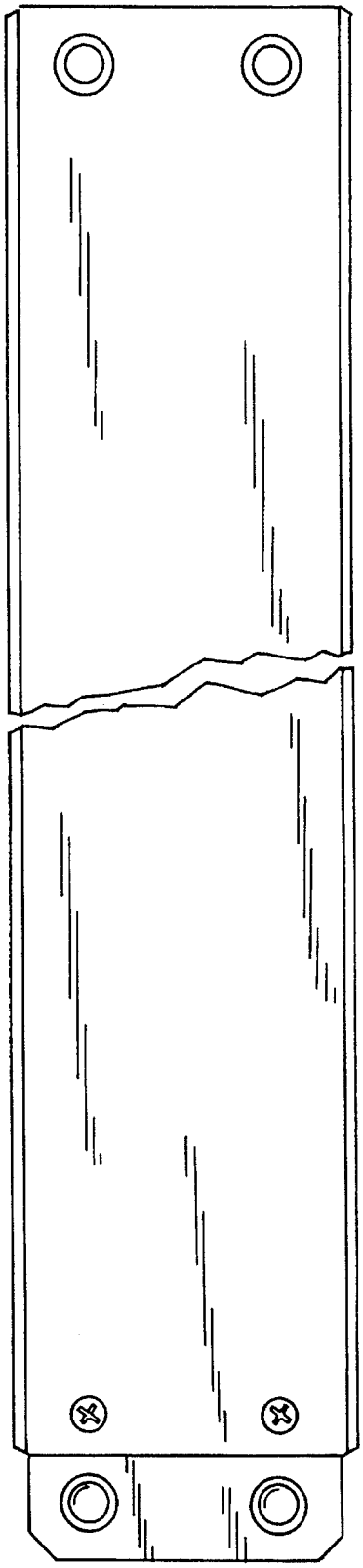
FIG. 6 is a schematic front view of a receptor for cartridge attachment of the system of the present invention.
Figure 7:
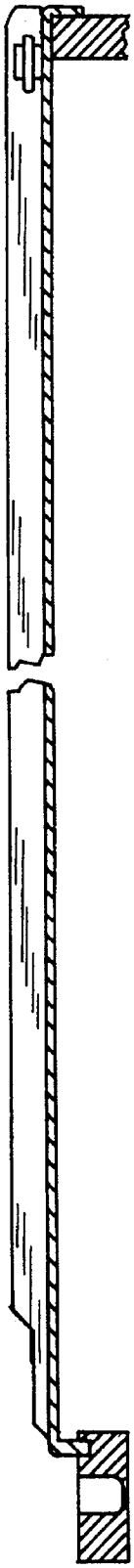
FIG. 7 is a partial schematic sectional view of a portion of a carousel of the system of the present invention to show the receptor for a cartridge attachment to the carousel.
Figure 8:
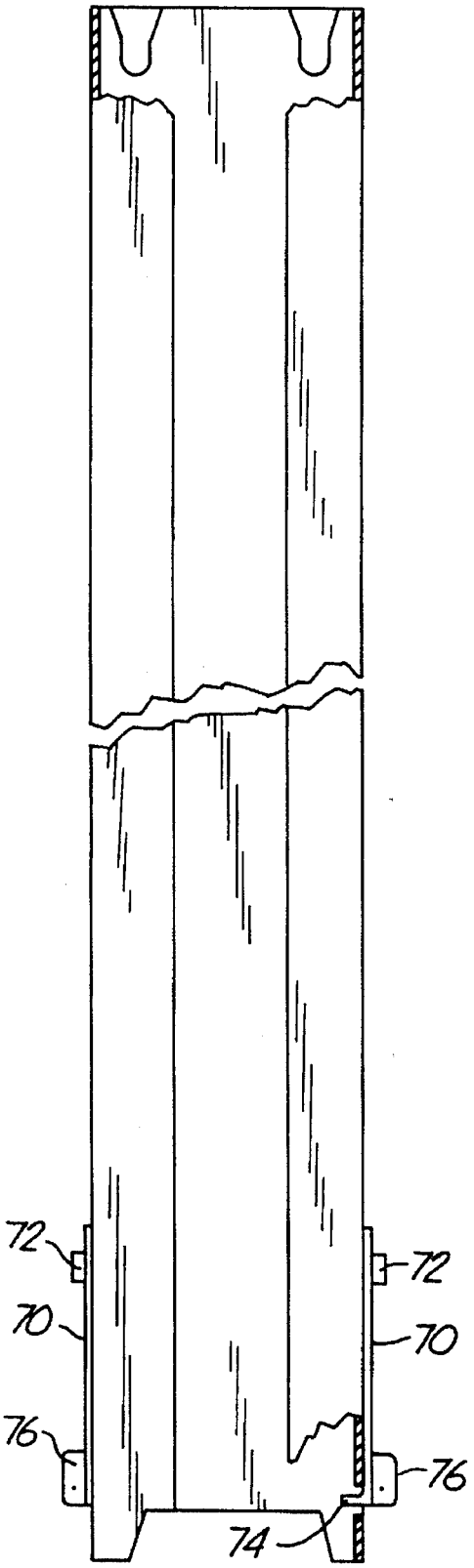
FIG. 8 is a schematic front view of a cartridge of the system.
Figure 9:
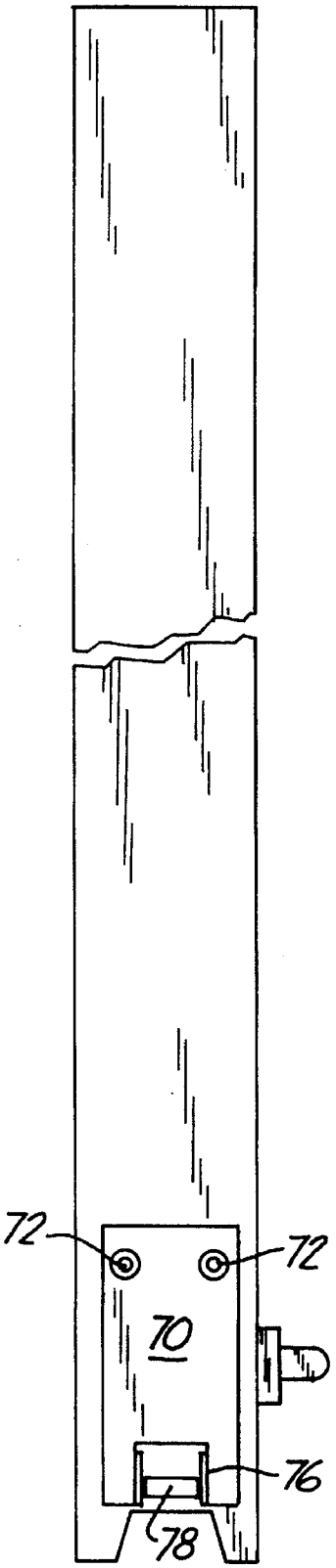
FIG. 9 is a schematic side view of a cartridge of the system showing one of the two mirror image release mechanisms.
Figure 10:
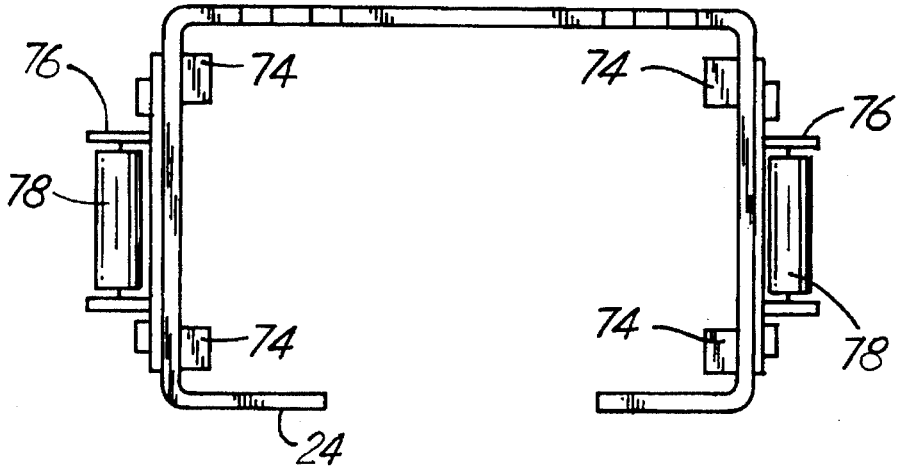
FIG. 10 is a cross sectional view of the cartridge
Figure 11:
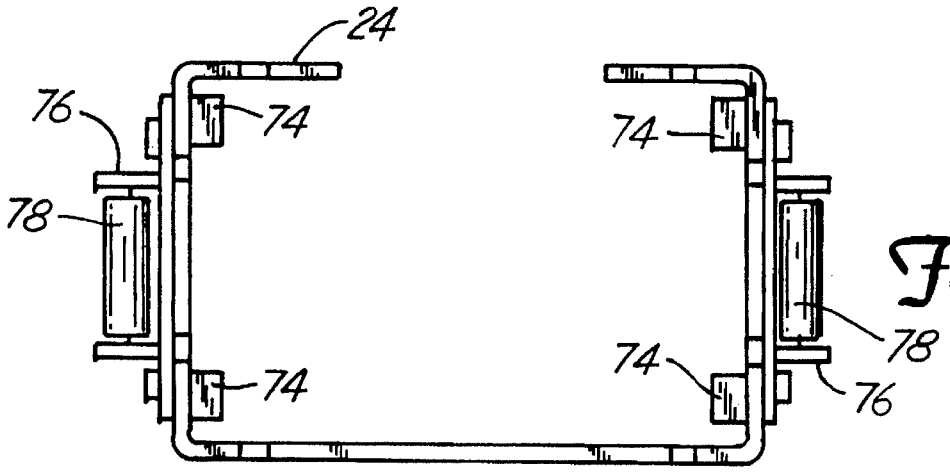
FIG. 11 is a cross sectional view of the cartridge.

As shown in FIG. 5, 8 and 9 the release mechanism for dropping stacks 26 of labels 28 from the cartridges 24 is preferably provided on opposing lower sides of each cartridge 24. For ease of understanding, only one side of the mechanism will be explained in detail; the opposing side being substantially a mirror image of that which is explained herein. The release mechanism includes a flat spring 70, held adjacent an upper edge of the spring 70, preferably by two fasteners 72. Adjacent the lower edge of the spring 70, an inward directed finger, or preferably two fingers 74, obstructs the lower end 44 of the cartridge 24. An outward directed bracket 76 holds a cam roller 78. As the carousel 32 drops downward, cam roller 78 is moved outward from the cartridge 24 by a stationary cam ramp 80, deflecting the spring 70 and withdrawing the fingers 74 from the interior of the cartridge 24, thereby releasing the stack 26 of labels 28 to drop into chute 48, while the lowermost label 28 *a* is controlled by tipping paddle 50.

Because the spring 70 resiliently urges the fingers 74 into the cartridge 24, stacks of labels 28 will be held as the cartridge 24 is loaded or as the cartridge is carried by the carousel 32. Achievement of docking orientation of the cartridge 24 with the port 46 of the chute 48 is facilitated by tapered mating surfaces 82 on the bottom of the cartridge 24 which interact with complementary mating surfaces 84 on the port 44. These mating surfaces 82 and 84 serve to assure the appropriate alignment and centering between the bottom 44 of the cartridge 24 and the port 46 of the chute 48 immediately prior to release of the stack 26 by camming out of the fingers 74.

The actuation of the air cylinder 36 to raise or lower the carousel 32 is controlled by standard position sensing switches (not shown) which in turn control air valves (not shown) to admit or release pressurized air from the air lift cylinder 36. A pawl mechanism 94 also driven by an air cylinder rotates and indexes the carousel 32 by an indexing plate 96 into general alignment between each successive cartridge 24 and the port 46 to chute 48.

Preferably, the carousel 32 carries 12 cartridges 24, each evenly and regularly distributed about the periphery 38. In this preferred embodiment, the carousel 32 advances 30° for each cartridge 24.

Although the present invention has been described with reference to the preferred embodiments, workers skilled in the art will recognize that changes may be made in form and detail without departing from the spirit and scope of the invention.

What is claimed is:

1. A device for supplying stacked labels to a labeling machine, comprising:

a cartridge for carrying a stack of labels;

a chute, located below the cartridge, for receiving the stack of labels from the cartridge; and guide means comprising a lever arm assembly, comprising a lever arm pivot and counter balance weight for controlling a lower most label of the stack of labels while the stack is lowered from the cartridge into the chute.

2. The device of claim 1 and wherein the chute defines an arcuate pathway.

3. The device of claim 2 wherein the pivot is generally common with the centerpoint of the arcuate pathway.

4. The device of claim 1 wherein the guide means includes a retractable engagement means for contacting the lower most label.

5. The device of claim 4 and wherein the retractable engagement means includes a tipping paddle.

6. The device of claim 4 and wherein the retractable engagement means moves toward the counterweight to disengage from the lower most label subsequent to controlling the lowermost label.

7. The device of claim 4 and wherein the retractable engagement means includes a solenoid mechanism.

8. The device of claim 1 and wherein the cartridge is one of a plurality of cartridges.

9. The device of claim 8 and wherein the plurality of cartridges are carried by a rotating carousel.

10. The device of claim 9 and wherein the carousel includes a vertical motion to sequentially match each of the cartridges to the chute.

11. The device of claim 10 and further comprising, means for determining a docking orientation of the cartridge to the chute, prior to release of the stack.

12. The device of claim 1 and wherein the cartridge includes fingers for supporting the lower most label of the stack.

13. The device of claim 12 and wherein the fingers are withdrawn to release the stack to the chute.

14. The device of claim 10 and wherein the fingers are withdrawn by a stationary cam as the cartridge is matched to the chute.

15. A method for resisting separation of a lowermost label from a dropping stack of labels, the method comprising the steps of:

providing a paddle assembly having a lever arm, a paddle at one end, a counterweight at an opposite end and a pivot positioned between the first and second ends, the paddle having a generally upward directed surface for initial contact with the underside of the lowermost object of the stack;

providing an upward directed force to the paddle, the upward directed force sufficient to resist the separation of the lowermost label but insufficient to substantially impede the drop of the stack.

16. The method of claim 15 and further comprising the step of:

withdrawing the paddle from under the lowermost label subsequent to lowering the stack of labels.

17. The method of claim 15 and wherein the paddle is carried on a lever arm the lever arm having a pivot and a counter weight and the withdrawal step includes moving the paddle toward the counter weight.

18. The method of claim 17 and wherein the step of withdrawal of the paddle toward the counter weight allows the paddle to return to an initial position to control the lower most label of a subsequent stack of labels.

19. A system for dependably supplying stacks of labels to a high speed labeling machine, the system including:

a plurality of cartridges for carrying stacks of labels, each having a release mechanism comprising a lever arm, pivot and counter weight at the lower end of the cartridge;

a carousel for carrying the cartridges in a vertical orientation with release mechanism directed downward;

an arcuate chute having a centerpoint, and an upper port of the chute situated to receive the release mechanism of the cartridges of the carousel; and a retractable paddle carried on a first end of a lever arm, the lever arm having a pivot mount in common with the centerpoint of the arcuate chute, and a counterweight at a second end of the lever arm.

20. The system of claim 19 and wherein the carousel includes a vertical movement to sequentially lower each of the cartridges into contact with the upper port of the chute and release any stack of labels therein onto the retractable paddle.

* * * * *